US005192865A

United States Patent [19]

Zhu

[11] Patent Number: 5,192,865

[45] Date of Patent: Mar. 9, 1993

[54] ATMOSPHERIC PRESSURE AFTERGLOW IONIZATION SYSTEM AND METHOD OF USE, FOR MASS SPECTROMETER SAMPLE ANALYSIS SYSTEMS

[75] Inventor: Jianzhong Zhu, Omaha, Nebr.

[73] Assignee: Cetac Technologies Inc., Omaha, Nebr.

[21] Appl. No.: 821,770

[22] Filed: Jan. 14, 1992

[51] Int. Cl.[5] ..... H01J 49/04

[52] U.S. Cl. ..... 250/288; 250/281; 250/282

[58] Field of Search ..... 250/288, 288 A, 281, 250/282, 423 R; 315/111.21, 111.81

[56] References Cited

U.S. PATENT DOCUMENTS

| | | | |
|---|---|---|---|
| 3,254,209 | 5/1966 | Fite et al. | 250/288 |
| 3,555,272 | 1/1971 | Munson | 250/288 |
| 3,610,921 | 10/1971 | Major, Jr. | 250/288 |
| 3,619,605 | 11/1971 | Cook | 250/288 |
| 4,309,187 | 6/1982 | Dodge, III et al. | 325/111.11 |
| 4,546,253 | 10/1985 | Tsuchiya et al. | 250/288 |
| 4,586,368 | 5/1986 | Rice et al. | 356/311 |
| 4,629,478 | 12/1986 | Brawner et al. | 250/288 |
| 4,730,111 | 5/1988 | Vestal | 250/288 |
| 4,861,988 | 8/1989 | Henion et al. | 250/288 |
| 4,863,491 | 9/1989 | Brandt et al. | 250/288 |
| 4,883,958 | 11/1989 | Vestal | 250/288 |
| 4,902,099 | 2/1990 | Okamoto et al. | 250/288 |
| 4,935,624 | 6/1990 | Henion et al. | 250/288 |
| 4,955,717 | 9/1990 | Henderson | 250/288 |
| 4,958,529 | 11/1990 | Vestal | 250/288 |
| 4,968,885 | 11/1990 | Willoughby | 250/288 |
| 4,977,785 | 12/1990 | Willoughby et al. | 250/288 |
| 4,980,057 | 12/1990 | Dorn et al. | 250/288 |
| 4,996,424 | 2/1991 | Mimura et al. | 250/288 |
| 5,015,845 | 5/1991 | Allen et al. | 250/288 |
| 5,051,557 | 9/1991 | Satzger | 315/111.21 |

OTHER PUBLICATIONS

Pullen et al., J. Chromatograph, 474, p. 335, 1989, "Corona Discharge Ionization Liquid Chromatography Mass Spectrometry Interface For Target Compound Analyses."

Horning et al., J. Chromatogr. Sci., 45, 6, p. 936, 1973, "New Program Detection System Based on a Mass Spectrometer with an External Ionization Source at Atmospheric Pressure."

Kambara, Anal. Chem., 54, p. 143, 1982, "Sample Introduction System for Atmospheric Pressure Ionization Mass Spectrometry of Nonvolatile Compounds."

Sakairi, et al., Anal. Chem., 60, p. 774, 1988, "Characteristics of a Liquid Chromatograph/Atmospheric Pressure Ionization Mass Spectrometer."

(List continued on next page.)

*Primary Examiner*—Jack I. Berman
*Assistant Examiner*—Kiet T. Nguyen
*Attorney, Agent, or Firm*—James D. Welch

[57] ABSTRACT

An system and method for use for analyzing samples in mass spectrometers using afterglow metastable species at atmospheric pressure to controllably dissociate, fragment and ionize sample is disclosed. Metastable species are created at atmospheric pressure by application of adjustable intensity and/or frequency electrical energy in one portion of a modular electric discharge chamber, then are caused to interact with sample in a distally located portion of the electric discharge chamber, termed the "afterglow" portion, to produce ionized sample molecules and ionized sample fragments etc. The system and method can be used with any source of sample but a preferred embodiment utilizes an ultrasonic nebulizer to nebulize sample solutions, such as conventional liquid chromatography system effluents, into sample solution droplets, followed by desolvation thereof to provide nebulized sample particles, prior to sample entry to the "afterglow" portion of an electric discharge chamber. Ionization of sample occures as a result of interaction with energy released by relaxing metastable species. Operation at atmospheric pressure reduces operational, contamination and maintenance problems and allows easy introduction of sample in a liquid form.

26 Claims, 2 Drawing Sheets

OTHER PUBLICATIONS

Sakairi et al., Mass Spectroscopy, 31, p. 87, 1983, "An Interface for Liquid Chromatograph/Mass Spectrometer Using Atmospheric Pressure Ionization Coupled with a Nebulizing Sample Introduction System."

McLuckey et al., Anal. Chem., 60, p. 2220, 1988, "Atmospheric Sampling Glow Discharge Ionization Source for the Determination of Trale Organic Compounds in Ambient Air."

Shen et al., Anal. Chem. 63, p. 1960, (1991), "Development of a Low-Power Microwave Atmospheric Pressure Molecular Ionization Source for Mass Spectrometry with Direct Introduction of Gaseous and Organic Samples."

Scott et al., J. Chrom. 99, pp. 394 (1974), "Interface for On-Line Liquid Chromatography-Mass Spectroscopy Analysis."

Horning et al., J. Chromat. Sci., 12, p. 725, (1974), "Atmospheric Pressure Ionization (API) Mass Spectrometry Solvent Medicated Ionization of Sampler Introduced in Solution and in a Liquid Chromatography Effluent Stream."

Sofer, Appl. Spec., 44, p. 1391, (1990), "An Atmospheric-Pressure Glow Discharge Ionization Source."

Vestal and Blakely, Anal. Chem., 55, p. 750, (1983), "Thermospray Interface for Liquid Chromatography/-Mass Spectrometry."

ATMOSPHERIC PRESSURE AFTERGLOW IONIZATION SYSTEM AND METHOD OF USE, FOR MASS SPECTROMETER SAMPLE ANALYSIS SYSTEMS

TECHNICAL FIELD

The present invention relates to ionization systems for use in mass spectrometer sample analysis systems. More particularly the present invention is a system and method for controllably producing sample molecular and/or fragment etc. ions at atmospheric pressure, utilizing intermediary afterglow metastable species produced by radio frequency electrical energy discharge at a location remote from the point of interaction with the sample.

BACKGROUND

The use of mass spectrometer (MS) sample analysis systems, to analyze structure and composition of samples is well known. Generally sample analysis in MS sample analysis systems involves four steps, namely: (1) sample introduction; (2) ion generation; 3) ion separation; and (4) ion detection. By far, the steps most critical to successful MS sample analysis system operation are those concerning sample introduction and ion generation.

In the case where a sample is a gas flow on the order of one (1) mililiter per minute, sample introduction can be a relatively simple matter. Gas phase sample molecules can be directly introduced into the MS ionization chamber and ionized and fragmented therein by for instance: electron impact ionization (EI), chemical ionization (CI), fast atom bombardment (FAB) ionization, or interaction with energy in metastable species or photons, depending on the ionization method used. However, when the sample is a liquid solution, such as conventional liquid chromatography (LC) system effluents, sample introduction becomes much more difficult. Even when conventional LC effluent mililiter-per-minute sample solution flow rates are reduced by a factor of one-thousand (1000) by flow splitting, prior to introduction into a low pressure MS environment, maintaining a ten-to-the-minus-fifth Torr pressure therein has proven to be very difficult when Direct Liquid Injection (DLI) sample introduction systems are used, (see Pullen et al., J. Chromat., 474, p. 335–343, 1989). In addition, flow splitting reduces sample analysis system sensitivity and precludes application to very small sample volumes.

One technique, other than flow splitting and direct liquid injection, directed to solving the problem of introducing liquid sample into low pressure MS ionization chamber or detector elements utilizes a moving belt system. Moving belt systems are discussed by Scott et al., (J. Chrom., 99, p. 394, 1974), and involve transport of sample by a stainless steel wire through a series of vacuum locks in which solvent present is removed by a vaporization process. Residue sample analyte on the stainless steel wire is entered directly into the low pressure MS ionization chamber. Another technique involves use of particle beam generating systems. U.S. Pat. No. 4,968,885 to Willoughby describes a system which utilizes a combined thermal and pneumatic approach to generating nebulized sample particles. Another U.S. Pat. No. 4,977,785 to Willoughby et al. emphasizes aerosol generation by decompression of a liquid or supercritical fluid stream. A patent to Brandt et al. U.S. Pat. No. 4,863,491 describes a system for separating particles from a gas stream in a vacuum chamber through a capillary inlet at supersonic speed. A patent to Browner et al., U.S. Pat. No. 4,629,478 describes a system which forms a stable jet of liquid sample flow at a velocity allowing columnar breakup into droplets of uniform size and spacing. An intersecting gas flow serves to disperse the results. A patent to Dorn, U.S. Pat. No. 4,980,057 describes a system for generating nebulized sample particles from a liquid sample which utilizes both pneumatic and ultrasonic means. U.S. Pat. Nos. 4,883,958 and 4,958,529 to Vestal describe spraying systems which can be used to produce nebulized particles from liquid sample. Separate pressure reducing skimming means are required to prepare and enter particle beams into low pressure MS sample analysis system ionization chamber and detector elements.

Additional techniques for coupling liquid samples into low pressure MS have been derived which greatly increase the analysis capabilities of MS sample analysis systems. The most important of these involve techniques which directly generate ions from liquid samples.

Thermospray systems are an example of such systems, and are described in a paper by Vestal and Blakely, (Anal. Chem., 55, p. 750–754, 1983). This paper describes a thermospray technique in which LC eluent containing a modifier such as ammonium acetate is passed through a heated capillary tube to rapidly evaporate the solvent present. Most of the evaporated solvent is pumped away and ionized sample analytes produced are directed into a MS for detection. A patent, U.S. Pat. No. 4,730,111 to Vestal also describes a thermospray system as do U.S. Pat. Nos. 4,883,958 and 4,958,529 to Vestal.

Other examples of systems which directly generate ions from liquid samples in atmospheric pressure are ionspray and electrospray systems.

A patent to Henion et al. U.S. Pat. No. 4,861,988 describes an ion spray sample nebulizer system which sprays sample into an atmospheric pressure ionization chamber through a stainless steel capillary tube. An impressed electric field produced by application of a plus or minus approximately 3 KV to the stainless steel capillary serves to form ionized particles. Another patent to Henion et al., U.S. Pat. No. 4,935,624 describes a similar system, but provides for application of thermal energy. The later Patent also describes use of the thermally assisted system without application of the plus or minus approximately 3 KV.

A patent to Allen et al., U.S. Pat. No. 5,015,845 describes an electrospray system which produces nebulized ionized sample particles by applying a high voltage to a capillary tube which contains liquid sample, at atmospheric pressure or above. There is no concurrent gas flow, heated or otherwise involved. The electrosprayed droplets produced are passed into a low pressure heated ion generating chamber in which solvent is removed therefrom, to produce ionized molecules for analysis in MS sample analysis systems.

Other techniques for ionizing nebulized sample particles to provide ionized sample molecules and ionized sample fragments etc. prior to entry to a MS low pressure region are identified by the term "Atmospheric Pressure Ionization" (API). API ionization systems include those which utilize Beta Particle Emitters, Corona Discharge and Direct Current Glow Discharge, and Plasmas such as Inductively Coupled Plasmas (ICP), to provide sample molecules and fragments etc. in ionized form.

Papers by Horning et al, (Anal. Chem., 45, p. 936-943, 1973) and (J. Chromatog. Sci., 12, p. 725-729, 1974) describe atmospheric pressure sample ionization systems which utilize both nickle-63, beta-particle emitter and needle to plane corona discharge ion sources.

A paper by Sofer, (Appl. Spec. 44, p. 1391-1398, 1990) describes an atmospheric pressure direct current glow discharge source used as a means to enhance the ionization efficiency and sensitivity of API/MS systems. A glow discharge in one atmosphere helium is described which penetrates into an extended region of space at currents hundreds of times higher than in corona discharge.

A patent to Tsuchiya et al., U.S. Pat. No. 4,546,253 describes a means for producing metastable species at atmospheric pressure by use of a high voltage induced corona discharge from a needle shaped emitter, which during use is situated in a stream of carrier matrix gas. Metastable species produced are directed by the flow of carrier matrix gas to a specimen which becomes ionized as a result of interaction with said metastable species and the presence of the high voltage at the needle shaped emitter. Use with liquid chromatography derived sample solutions and mass spectrometers is also described.

A patent to Dodge III et al., U.S. Pat. No. 4,309,187 describes a system in which nitrgen molecules are excited in a dielectric field to form metastable energy level nitrogen. Said metastable nitrogen is mixed with a gas stream containing atomic species and interaction causes fluorescence thereof, which fluorescence is analyzed to determine the identity and concentration of said sample atoms species. The Dodge III et al. Patent teaches that the nitrogen partial pressure should be at between one (1) and three-hundred (300) Torr during use, hence is not a true API system.

The API Corona Discharge and Direct Current Glow Discharge systems described operate at low power, (e.g. less than 1 watt), or utilize needle shaped electrodes to develop or sustain electric discharge at atmospheric pressure and high voltage. Too high a voltage, however, can cause discharge instability and metastable species created by discharge from a needle point electrode lose energy quickly through ionizing collisions with matrix gas and solvent present in the vicinity of the needle electrode. Sample particles are ionized by interaction with matrix gas and solvent ions, resulting in a soft, chemical, ionization in which very little sample fragmentation occurs.

Continuing, it is advantageous to operate both sample nebulizer and nebulized sample particle ionizing systems at atmospheric pressure because operational, contamination and maintenance problems are reduced. For instance, interfacing to liquid form samples is more convenient at atmospheric pressure. Also, a sample ionization system can be modularly removed from a MS sample analysis system and serviced without requiring its sample analysis detector be brought to atmospheric pressure. As well, where non-ionizing sample nebulizer means are used and produced nebulized sample particles must be ionized, the presence of a higher ambient pressure in the sample ionizing system, (hence greater number of energy containing intermediaries), leads to more ionizing interactions between nebulized sample particles and energy containing ionizing intermediaries.

As alluded to above, during sample analysis it is often desired to determine not only the molecular weight of a sample molecule, but also that of the structural fragments etc. thereof. This is often accomplished presently by use of tandem MS/MS systems in which the first MS stage separates, and isolates a sample molecule of interest and determines the molecular weight thereof. Some of said separated and isolated sample molecules are then subjected to fragmenting forces and the resulting ionized sample fragments etc. produced are entered to the second stage of the tandem MS system in which the ionized fragments are separated and detected. Tandem MS/MS systems, however, can be very expensive. In addition, problems develop during use because of contamination in the low pressure chambers, difficulty in maintaining low pressures in sample ionizing and fragmenting systems, and in maintaining proper alignment of the stages. A system which provides the benefits of tandem MS/MS systems and which operates at atmospheric pressure would therefore be desirable.

As mentioned above, the use of ICP's is an API ionization approach. ICP's have been very successfully used as an ionization source for elemental analysis since a higher power, (e.g. 1000 watts), typically fragments sample particles into elemental ions. However, the parent molecules from which the elemental ions are derived are essentially lost in the ionization process. As a result, ICP's are particularly unsuitable for use in analyzing organic component analytes.

It should be appreciated that high energy electrical discharge is associated with improved sample ionization, hence, increased API sample analysis system sensitivity. In addition, the efficiency of production of sample molecular fragments for use in structural analysis is improved as the power intensity of an electric discharge applied to a sample is increased. Use of very high electrical energy discharge in ICP's, however, is associated with complete fragmentation of a sample and relatively complete loss of sample molecules. A technique which would provide the benefits associated with application of high electrical energy discharge, without the drawbacks associated therewith, would therefore be of great utility. Such a technique is introduced in a patent to Rice et al., U.S. Pat. No. 4,586,368. The Rice et al. system provides an electrodless API discharge system which generates afterglow metastable intermediary species, the energy in which is used at a remote location to controllably fragment and ionize sample. The Rice et al. system, however, does not provide for interfacing to a mass spectrometer, but instead teaches that sample analysis should be by optical means.

The above shows that benefits are available when samples are ionized and fragmented by use of intermediary metastable species produced by API techniques. However, no reference cited teaches an API system and method of use which at once:

- allows nebulization and desolvation of sample solution;
- provides large numbers of metastable species and nebulized desolvated sample at a common location remote from the location at which metastable species are produced;
- increases MS sample analysis system sensitivity by efficiently utilizing energy in metastable species to ionize sample molecules and fragments etc., in a modularly separate ionization system; and
- can controllably produce sample molecules or sample fragments etc. in proportions desired by a user.

A need for additional, modular, atmospheric pressure ionization means for use in mass spectrometer sample analysis systems is thus identified which can:

provide reduced background noise in MS sample analysis system results by limiting nonsample analyte ion production via removal of solvent from nebulized liquid sample prior to ionization thereof and entry into a MS ion detector, controllably provide ionized sample molecules, and/or sample fragments etc. in proportions as desired by a user thereof;

provide increased MS sample analysis system sensitivity by generating and efficiently utilizing the energy in large numbers of intermediary metastable species in sample fragmentation and ionization processes.

DISCLOSURE OF THE INVENTION

The present invention meets the need identified in the Background Section of this Disclosure. The overall system of the present mass spectrometer (MS) sample analysis system invention comprises a sample introduction means, an electric discharge chamber system for use in metastable species mediated sample ionization at atmospheric pressure, a mass spectrometer system comprising ion focusing and separating elements, and means for interconnecting the electric discharge chamber with the mass spectrometer system, such as a momentum separator, skimmer and roughing pump system. The most important element of the present invention system, however, is the electric discharge chamber system.

The primary element of the electric discharge chamber system is an electric discharge chamber. Electrical energy is provided to one portion of the electric discharge chamber, typically by means of a capacitive discharge between an outer electric coil or electrode which encompasses the outer surface of said portion of the electric discharge chamber, and an inner electrode inside thereof. Electromagnetic energy can also, or alternatively, be entered to the electric discharge chamber via induction, by applying electrical energy to the outer electric coil. Delivered electrical power levels are user adjustable from approximately one (1) to one-hundred-fifty (150) watts. Continuing, a matrix carrier gas is entered into said portion of the electric discharge chamber and interacts with the electric energy present during electric discharge to form metastable species. The metastable species formed are transported to another, distally located, portion of the electric discharge chamber, termed the "afterglow" region, normally under the influence of a pressure gradient created by entry of the matrix carrier gas. During use sample is entered directly into the afterglow region, where it interacts with the energy present in the metastable species, as said energy is released therefrom during relaxation thereof, to form ionized sample molecules and ionized sample fragments etc.

While sample can be introduced from any source, a preferred liquid sample solution introduction source typically utilizes pneumatic or preferably ultrasonic nebulizer systems which accept a mobile liquid phase sample solution and nebulize it into a large number of small diameter (e.g. seventy (70%) percent are less than thirteen (13) microns in diameter when CETAC Technologies Inc. U5000AT (trademark), ultrasonic nebulizers are used), sample solution droplets. Said nebulized sample solution droplets are then typically subjected to a desolvation process to provide nebulized sample particles which can be directly introduced into the atmospheric pressure afterglow region of the electric discharge chamber, for production of ionized sample molecules and sample fragments etc., in proportions desired by a user. The relative proportions of ionized sample molecules and sample fragments etc. are determined by user control of the intensity and/or frequency of the electrical energy applied.

To aid understanding it should be appreciated that "afterglow" is a term used to describe a physical phenomenon of energy emission which occurs after the cessation of electrical discharge. Electrical discharge occurs in gasses when said gasses electrically "breakdown" under high electric fields. When breakdown occurs a large number of ions, electrons, electrically excited elemental atoms and molecules are generated. The term excited refers to, for instance, atoms and molecules, (i.e. species), in which the orbiting electrons thereof are in higher energy state orbitals than would otherwise be the case. The electrically excited species eventually return to their more stable lower energy states by loss of energy. Some excited species, however, do not lose energy immediately and are found to remain in an excited state for miliseconds to seconds after cessation of the electrical discharge which created them. Said excited atoms and molecules constitute the source of afterglow, are termed "metastable", and are very energetic. Metastable species can lose their energy by way of collisions with walls of the electric discharge tube in which they are contained or with matrix gas molecules which are also present therein, or by emission of EM wave radiation. Metastable species can also transfer their energy to nebulized organic or inorganic sample particles which are injected into an "afterglow". Interactions between metastable species and nebulized sample particles leads to particle dissociation and production of molecular ions and fragments etc., which fragments etc. can subsequently become ionized by the expulsion of electrons. Complete dissociation of nebulized sample particles to atoms and subsequent excitation or ionization of said atoms can occur.

Mechanisms of some of the processes involved can be represented symbolically as:

1. $M^* + A \text{———} M + (A+) + e-$; (Penning Ionization)
2. $M^* + A \text{———} M + (B+) + C + D + e-$;

where $M^*$ represents a metastable species and $(A+)$ represents an ionized form of A. Additionally, $(B+)$, C and D represent fragments of A, with $(B+)$ representing an ionized form of one such fragment.

Other mechanisms which can occur include simple charge and proton transfer:

1. $(M+) + A \text{———} M + (A+)$;
2. $M^* + 2HI \text{———} M + (H_2I+) + (I-)$;
3. $(H_2I+) + A \text{———} (AH+) + HI$;

where HI represents a proton donor intermediate or solvent molecule.

The above sampling of representative mechanisms of what occurs during afterglow metastable species relaxation when nebulized sample particles are present shows that what occurs is quite complex and that both positive and negative charged ions, and free electrons, can be produced; which ions are of sample particle molecules or fragments etc. thereof.

It is also mentioned that ionization processessduring an afterglow metastable species relaxation can occur as a result of soft chemical ionization, or as a result of hard collision induced ionization. The later mechanism is responsible for formation of sample fragments and is associated with higher input power intensities.

The effect of afterglow metastable species relaxation on specific samples is affected by such things as sample proton or electron affinity, polarity and volatility. Nonpolar samples (e.g. aromatic hydrocarbons), are most affected by collisions which cause ionization, while sample compounds with which have a high proton affinity are most affected by chemical reaction ionization.

It will be appreciated from the foregoing that energy provided by afterglow metastable species relaxation can interact with nebulized sample particles to provide a great variety of sample molecular ions and ionized sample fragments etc. which can be analyzed by MS sample analysis systems to provide both sample mass and structure data.

Continuing, as the afterglow metastable species relaxation is carried out at atmospheric pressure and MS's operate at an internal pressure on the order of ten-to-the-minus-fifth Torr, some means to interface the afterglow region of the electric discharge chamber of the present invention, to MS elements, is required. The present invention provides exemplary use of well known momentum separators, one or more skimmers, a draw-out plate, and an ion detection system such as a quadrapole mass analyzer, in combination with vacuum roughing pumps.

The present invention will be better understood by reference to the Detailed Description Section of this Disclosure and the accompanying drawings.

SUMMARY OF THE INVENTION

The use of mass spectrometer (MS) sample analysis systems, to analyze samples is well known. Sample analysis in MS sample analysis systems typically involves four steps, namely: (1) sample introduction; (2) ion generation; (3) ion separation; and (4) ion detection. Of the identified steps the sample introduction and ion generation steps are by far the most critical. Generally, MS sample analysis systems accept sample and if necessary nebulize it to provide a large number of small diameter particles, then ionize the sample so it can be transported into an ion detector element of the MS sample analysis system under the influence of an impressed electric field. Pressure gradients typically can not be used to induce sample transport in the low pressure MS (e.g. ten-to-the-minus-fifth Torr) environment because of restrictions on the amount of inlet gas flow which is tollerable thereby. It is also noted that well known efficient systems are available which perform ion separation and ion detection, and an atmospheric pressure source of ionized sample is typically interfaced to an ion detector element of a mass spectrometer by way of momentum separators, skimmers and vacuum pump systems.

Sample can be introduced to a MS sample analysis system from a sample analyte containing gas flow or from liquid mobile phase sample analyte containing solutions, such as liquid chromatography (LC) effluents. In the later case, when using atmospheric pressure ionization, small diameter nebulized sample droplets are typically first produced by subjecting the sample solution to a nebulizing process in, for example, pneumatic or ultrasonic nebulizers. When a CETAC Technologies Inc. U5000AT (trademark), ultrasonic nebulizer system is used the majority, (e.g. typically in excess of seventy (70%) percent) of sample solution droplets produced are of a consisitent, small, (e.g. less than thirteen (13) microns), diameter. Preferably, nebulized sample solution droplets are also desolvated to form nebulized sample particles which are in an appropriate form to be subjected to an ionizing process.

Ionization of sample can include dissociation into molecules and fragments etc. and can be accomplished in vacuum or at atmospheric pressure. Atmospheric pressure ionization, however, is preferrable because of reduced operational, contamination and maintenance etc. problems and because coupling to liquid sample sources is relatively easier than when low pressure ionizing systems are used. One technique of atmospheric pressure ionization involves use of Corona Discharge. While sample particles are ionized by this approach, the collision temperature provided by Corona Discharge is generally not sufficient to dissociate significant numbers of sample particles introduced thereto. Approaches utilizing Beta Particle Emitters also are subject to this drawback. Said sample dissociation into sample molecules and fragments etc. can be of benefit when it is desired to determine the structural components of a sample molecule for instance. Techniques utilizing Inductively Coupled Plasmas (ICP's), on the other hand, lead to production of an abundance of ionized sample fragments etc., and very few sample molecules. An intermediate result can be achieved by capacitive or inductive application of adjustable, (as regards intensity and/or frequency of operation), electrical energy to a matrix carrier gas to produce metastable species, the energy in which metastable species can in turn interact with sample when it is released during relaxation of said metastable species to a lower energy state. Said metastable species can remain in a high energy state for from miliseconds to seconds after cessation of an electric discharge which creates them, allowing them to be transported to locations distal to where the electrical energy is applied. Sample can be provided to said distal locations as well and when metastable species energy is released, significant numbers of both sample molecular ions and sample fragment ions can result.

It is therefore a purpose of the present invention to provide a modular atmospheric pressure ionization system for use with MS sample analysis systems which is easily removed from an overall MS sample analysis system, without requiring that the ion detector element therein be brought to atmospheric pressure.

It is another purpose of the present invention to provide an ionization system for use with MS sample analysis systems, the energy source of which can be adjusted to provide both ionized sample molecules and ionized sample fragments etc.

It is yet another purpose of the present invention to provide an ionization system for use with MS sample analysis systems which can provide sample molecule and sample fragment etc. ions in proportions desired and controllable by a user.

It is still yet another purpose of the present invention to provide a system which allows convenient interfacing of a source of liquid sample, such as liquid chromatography effluent, to a MS low pressure environment.

It is yet another purpose of the present invention to allow improved MS sample analysis system operation via reducing background noise, by desolvating nebulized liquid sample prior to fragmentation and ionization thereof.

It is another purpose of the present invention to identify a system for ionizing nebulized sample solution droplets and/or desolvated particles produced by non-ionizing nebulizing means such as pneumatic or ultrasonic nebulizers.

It is yet another purpose of the present invention to provide a system which utilizes the energy in metastable species to ionize sample molecules and to produce and ionize sample fragments etc. present in nebulized sample droplets and/or particles.

It is still yet another purpose of the present invention to provide that improved MS sample analysis system sensitivity can be achieved by generating and efficiently using the energy in large numbers of metastable species to fragment and ionize sample.

Yet still another purpose of the present invention is to teach an electric discharge chamber system of an afterglow ionization system for use in MS sample analysis systems using metastable species at atmospheric pressure to controllably fragment and ionize sample, which is of a relatively simple, yet effective, design and construction.

DETAILED DESCRIPTION

Figure 1A:
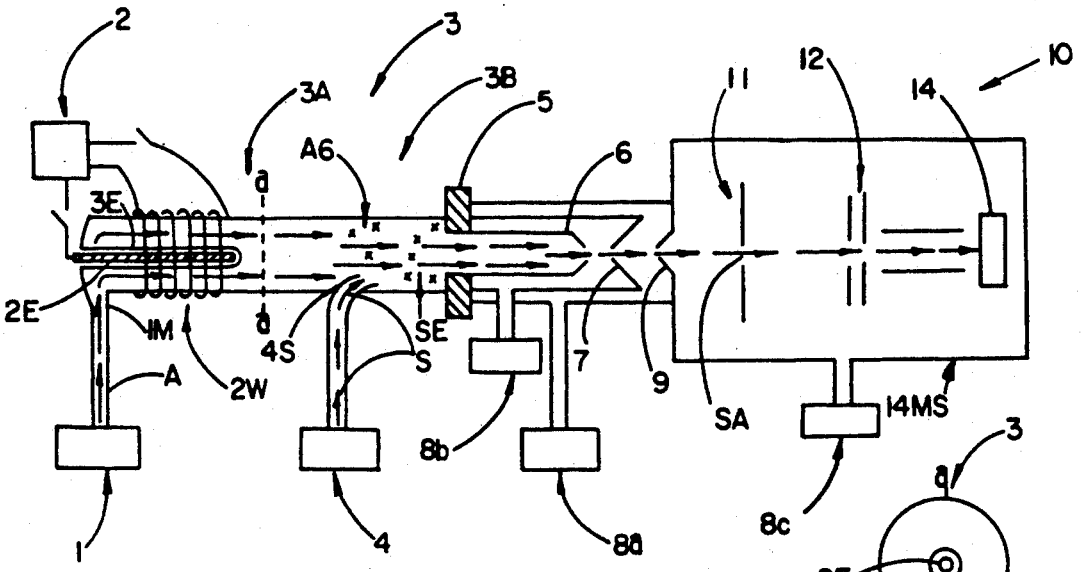
FIG. 1*a* shows the overall MS sample analysis system of the present invention in diagramatic form, including the afterglow electrical discharge ionization chamber system.
Figure 1B:
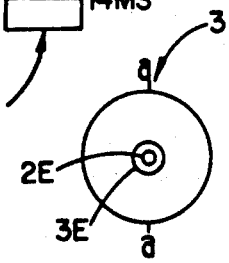
FIG. 1*b* shows a expanded scale cross sectional view looking back into the electric discharge ionization chamber shown in FIG. 1*a* taken at a—a in FIG. 1*a*.
Figure 4:
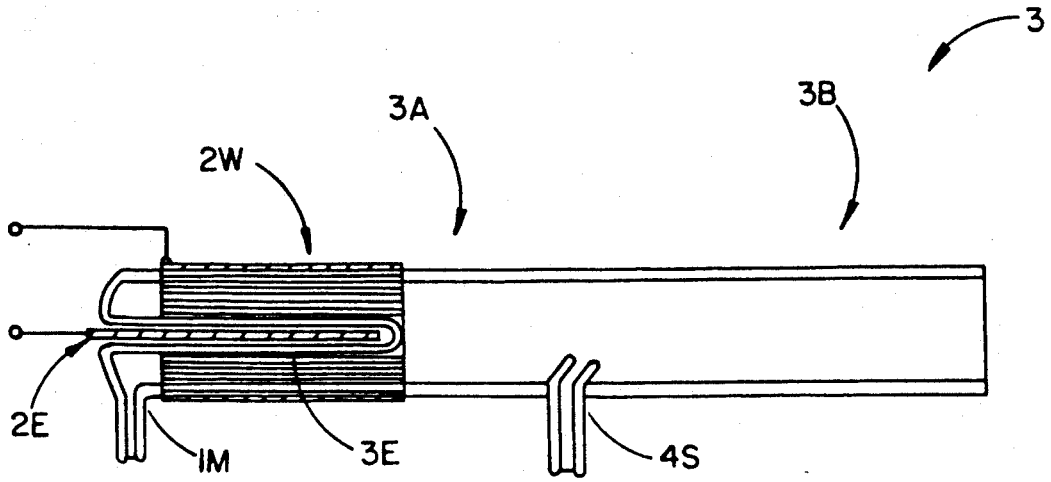
FIG. 4 shows an expanded side elevational cross sectional view of an electric discharge chamber with outer and inner electrodes present. Inner electrode is shown present in an enclosed tubular structure which is an integral part of the electric discharge chamber.
Figure 5:
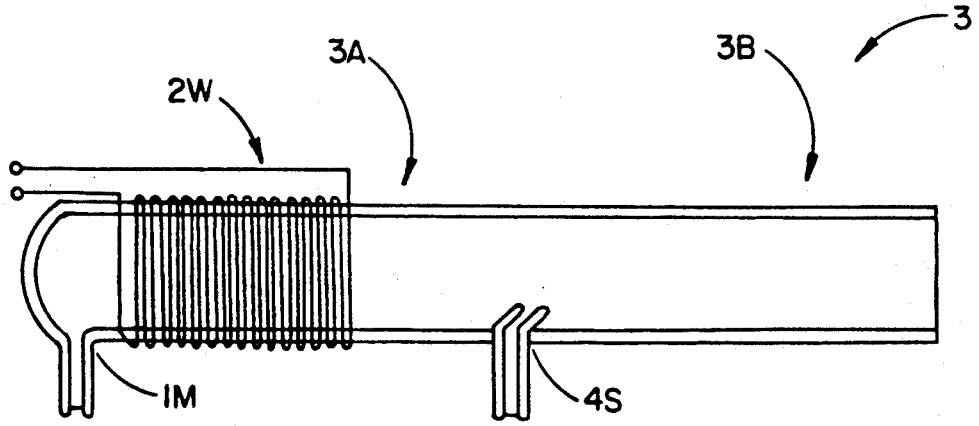
FIG. 5 shows an expanded side elevational cross sectional view of an electric discharge chamber with an outer electric coil present, and without an inner electrode present.

Turning now to the drawings, FIG. 1*a* diagramatically shows the MS sample analysis system (10) of the present invention. In particular there is shown a source (1) of matrix carrier gas "A" and a flow of matrix carrier gas into electric discharge chamber (3), portion (3A) through a means for accessing a source of matrix carrier gas (1M). Electric discharge chamber (3), at portion (3A) thereof, is also shown encompassed by an outer electric coil or electrode (2W), which outer electric coil or electrode (2W), at one end thereof is connected to electrical energy source (2), which electrical energy source (2) causes capacitively coupled electrical energy discharge between the outer electric coil or electrode (2W) and, centrally oriented inner electrode (2E) inside the electric discharge chamber portion (3A), at adjustable power intensity levels and/or operational radio frequencies. Note, however, that it is also possible to feed adjustable electrical energy to ends of outer electric coil (2W), rather than, or in addition to, between the outer electric coil or electrode (2W) and the inner electrode (2E), and thereby inductively provide electric discharge energy to the electric discharge chamber portion (3A). It is also noted that inner electrode (2E) or one end of outer electric coil (2W) might be fixed at ground potential during use. When present, inner electrode (2E) is typically enclosed within a closed tubular or equivalent structure (3E) which can be an integral part of the electric discharge chamber portion (3A) as shown in FIG. 1*a*. Note FIG. 1*b* shows an expanded cross sectional view taken at a—a in FIG. 1*a*, looking back into electric discharge chamber portion (3A). Closed tubular or equivalent structure (3E) prevents matrix carrier gas flow "A" from directly contacting inner electrode (2E) during use. FIGS. 4 and 5 show expanded cross sectional side elevational views of electric discharge chambers for use with and without inner electrodes. Element identification is the same as shown in FIGS. 1*a* and 1*b*. Again referring to FIG. 1*a*, atoms and molecules of matrix carrier gas flow "A" are caused to be excited by electrical discharge in the electric discharge chamber portion (3A) and become a flow of afterglow "AG" metastable species into the distally located afterglow portion or region of the electric discharge chamber (3) identified by (3B). Said afterglow "AG" metastable species are at atmospheric pressure and comprise energetic species which do not relax or discharge to low energy states for milliseconds to seconds after cessation of electrical discharge. Also shown entering the afterglow portion of the electric discharge chamber identified as (3B), at means for accepting sample (4S) from sample introduction system (4), is a sample flow "S". Sample particles in sample flow "S" become selectively dissociated into sample molecules and/or sample fragments etc. by interaction with the energy, (the magnitude of which is determined by user selected electric energy discharge intensity and frequency in electric discharge chamber portion (3A)), in afterglow flow "AG" metastable species to form excited sample flow "SE", which excited sample flow "SE" is comprised of ionized sample molecules, sample fragment ions and other components. Typically, the higher the power intensity of the electrical energy, (variable from approximately one (1) to one-hundred-fifty (150) watts), applied to the outer electric coil (2W) and/or between outer electric coil or electrode (2W) and the inner electrode (2E), the larger will be the proportion of sample fragment etc. ions and the lower will be the proportion of ionized sample molecules present in excited sample flow "SE".

To couple excited sample flow "SE" to the mass spectrometer (14MS) ion detector element (14), (which is at low internal pressure), excited sample flow "SE" is typically transported through a CAJON, (CAJON is a tradename), connector or equivalent (5), into a momentum separator (6) and first and typically second skimmers (7) and (9) respectively, where it becomes sample analysis flow "SA". CAJON connector or equivalent (5) is typically maintained at one-hundred-fifty (150) degrees Centigrade during use. Inside mass spectrometer (14MS) said sample analysis flow "SA" is typically induced by a voltage applied to draw out plate (11) and is guided by ion focusing lense system (12) into MS ion detector element (14). Also shown are vacuum roughing pumps (8*a*) and (8*b*). Vacuum pump (8*c*) is also shown and provides vacuum to the MS (14MS) internal elements. The low pressures provided by said roughing pumps (8*a*) and (8*b*) in the invention stages past the CAJON connector or equivalent (5) creates a pressure gradient between the atmospheric pressure in electric discharge chamber (3) and the location of the roughing pumps (8*a*) and (8*b*). Said pressure gradient, in conjunction with the matrix carrier gas flow, provides the driving force for the transport of the metastable species "AG" flow to the afterglow portion of the electric discharge chamber (3B), and ionized sample molecules and sample fragment etc. ions transport "SE" flow, through the system to the point of the CAJON connector or equivalent (5). Past the CAJON connector or equivalent (5), as mentioned above, sample flow "SA" is driven by the effect of an electric field created by a voltage applied to draw-out plates (11), on the ionized sample molecules and sample fragments etc.

An electric discharge chamber system for use in mass spectrometer sample analysis systems using metastable species at atmospheric pressure to controllably fragment and ionize sample, it is noted, is comprised of electric discharge chamber (3), portions (3A) and (3B), outer electric coil or electrode (2W), inner electrode (2E) when used, means for accessing a source of matrix carrier gas (1M), means for accepting sample (4S) and means for connecting to a MS ion detector element. It is pointed out that said electric discharge chamber system is of relatively simple design and construction. An afterglow ionization system is achieved by addition of an adjustable source of electrical energy (2), a source of matrix carrier gas (1), and a source of sample (4). A mass spectrometer sample analysis system (10) is achieved by adding other elements shown in the Figures to the above identified elements to provide full sample analysis capability.

While not constituting limitations, it is mentioned that a typical electric discharge chamber will be elongated essentially, (including other than circular cross sectional geometries), tubular in shape, made of quartz and less than one (1) centimeter inner diameter. Inner electrode (2E) is typically unpointed and approximately one-eighth (⅛) inch outer diameter. Closed ended electric discharge chamber portion (3A) is typically approximately ten (10) centimeters in length and open ended electric discharge chamber portion (3B) is typically approximately twenty (20) centimeters in length. In addition, outer electric coil (2W) can be considered to become an outer electrode when the windings thereof become so closely wound to one another so as to merge with one another. Hence, outer electric coil and outer electrode (2W) can be considered to be different limiting forms of one basic element. Also, while again not constituting limitations, a typical inlet matrix carrier gas, which can be argon or helium etc., flow rate of a few mililiters-per-minute is typical, as is an inlet sample flow rate on the order of a few mililiters-per-minute. Also, during use, a typical capacitive discharge voltage applied between the outer and inner electrodes will be on the order of one-thousand (1000) volts, with discharge voltage and currents inside the electric discharge chamber being of magnitudes adjustable to deliver one (1) to one-hundred-fifty (150) watts at radio frequencies, whether electric discharge is effected capacitively or inductively. The means for accessing matrix carrier gas (1M) and the means for accepting sample (4S) are typically essentially tubular projections from the electric discharge chamber (3). It is also mentioned that the means for accepting sample (4S) can be positioned in functionally equivalent locations to that shown in portion (3B) of the electric discharge chamber in FIG. 1*a*. The functional requirement being that during use sample is entered to electric discharge chamber portion (3B) in a manner such that electric discharge per se in electric discharge chamber portion (3A) does not adversely affect intended sample fragmentation and ionization via metastable intermediaries as described above. The means for accessing matrix carrier gas (1M) can also be provided in any functionally equivalent manner. The functional requirement being that matrix carrier gas be provided to electric discharge chamber portion (3A) during use such that metastable species produced can be transported to electric discharge chamber portion (3B).

Figure 2:
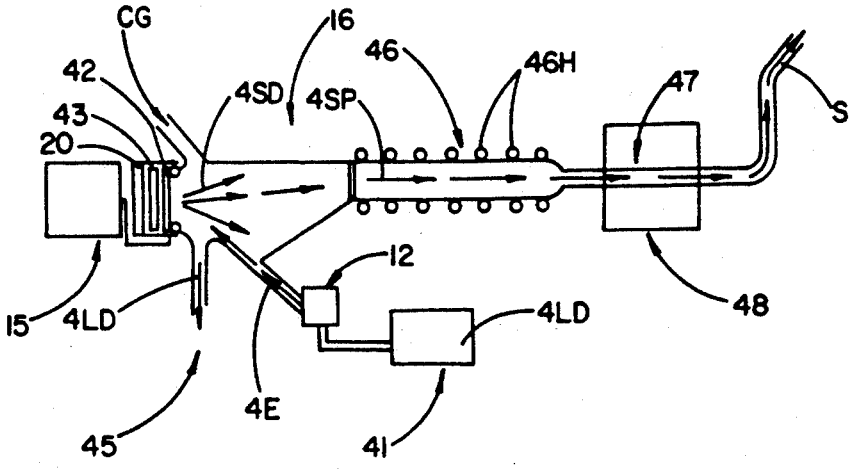
FIG. 2 shows a diagramatic view of the preferred sample introduction system of the present invention.
Figure 3:
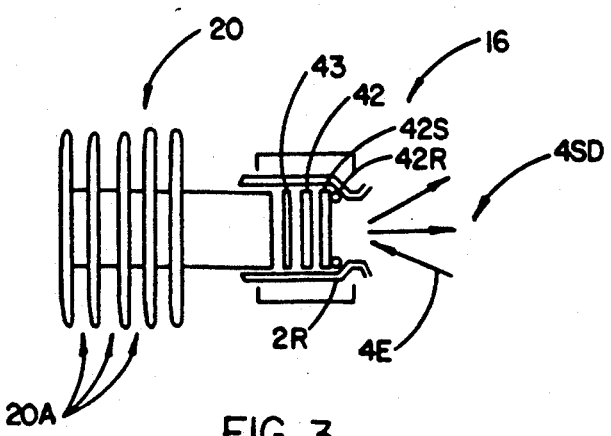
FIG. 3 shows an exploded view of the sample nebulizing elements of the preferred sample introduction system of the present invention.

Turning now to FIG. 2, there is shown a diagramatic view of the preferred embodiment of the sample introduction (4). It is to be understood that sample can be introduced in any, (e.g. gas or liquid) form, but when sample is provided in a liquid form FIG. 2 exemplifies the preferred nebulizer system. A source of sample solution (41) is shown connected to means for causing said sample solution (4LC) to impinge upon, or in close proximity to, piezoelectric crystal or equivalent (42) in aerosol chamber (16). The aerosol chamber provides an essentially tubular means for entering a sample solution flow thereto and an impinging sample solution flow is identified by numeral (4E). (The sample solution (4LC) can originate from any source). Piezoelectric crystal or equivalent (42) is caused to vibrate at, typically but not necessarily, one-and-three-tenths (1.3) Megahertz, by inclusion in an electric power source and oscillator circuit (15) of which it is a part. Also shown is a KAPTON film or equivalent (43), (KAPTON is a tradename for a polyimide material), which serves to reflect and help focus vibrational energy developed by the piezoelectric crystal or equivalent (42) to the location thereon, or in close proximity to thereto at which the sample solution (4E) impinges, in front of said piezoelectric crystal or equivalent. Said KAPTON film or equivalent (43) also serves as a compressible buffer means by which the piezoelectric crystal or equivalent (43) is attached to structural heat sink (20) at its point of connection to the aerosol chamber (16). FIG. 3 also shows in exploded fashion the KAPTON film or equivalent (43), the piezoelectric crystal or equivalent (42) and an insulator (42S) which is typically, but not necessarily, made of a glass material, present on the front surface of the piezoelectric crystal or equivalent (42). The purpose of the insulator (42S) is to protect the piezoelectric crystal or equivalent (42) against corrosion etc. due to components in the sample solutions impinged thereon. Also note by reference to FIG. 3 that when the structural heat sink (20) is slid fully into the aerosol chamber (16), the KAPTON film or equivalent (43), piezoelectric crystal or equivalent (42) and insulator (42S) will be sandwiched together between the structural heat sink (20) and a constriction in the aerosol chamber. Note that "O" ring (42R) is also shown sandwiched between the insulator (42S) and the constriction in the aerosol chamber. Said "O" ring (42R) serves to prevent sample retaining crevasses from forming at the point of interconnection. It is mentioned that electrical energy to the piezoelectric crystal or equivalent (42) from electrical oscillator circuitry (15) can be by any convenient pathway, but typically is by way of an opening in the structural heat sink (20). Also note in FIG. 3 the indication of cool air flow (20A) over fins in the structural heat sink (20). Said fins are located distally from the point of the structural heat sink which contacts the KAPTON film or equivalent. During use said cool air flow serves to maintain the piezoelectric crystal or equivalent at a desired temperature by way of heat conduction along the structural heat sink (20). Continuing, the compressible nature of the KAPTON film or equivalent (43) prevents the piezoelectric crystal or equivalent (42) from repeatedly vibrating against the rigid aerosol chamber (16) or structural heat sink (20) to which it is interfaced during operation. Said buffering prevents damage to the piezoelectric crystal or equivalent (43). Also, the KAPTON film or equivalent provides a uniform contacting interface between the vibrating piezoelectric crystal or equivalent (42) and the aerosol chamber (16) or structural heat sink (20). Uniform heat removal, and piezoelectric crystal or equivalent (42) to aerosol chamber (16) and structural heat sink (20) vibrational contact buffering during use, serve to stabilize the operation of and prolong the lifetime of the piezoelectric crystal or equivalent (42) of the present invention. Typically, a lifetime of years, rather than weeks (as is typically the case with piezoelectric crystals or equivalent in other ultrasonic nebulizer systems), is achieved.

Continuing, interaction between the vibrational energy produced by said piezoelectric crystal or equivalent (42) and impinging sample solution (4E) causes production of nebulized sample solution droplets (4SD). Seventy (70%) percent of said droplets are of a diameter of less than thirteen (13) microns when the frequency of vibration of the piezoelectric crystal or equivalent in the present invention is one-and-three-tenths (1.3) megahertz. Larger diameter droplets typically fall under the influence of gravity, and are removed from the system at drain (45). The remaining smaller diameter nebulized sample solution droplets (4SD) are caused to flow under the influence of a pressure gradient, typically created by entering a tangentially directed flow of carrier gas "CG" into aerosol chamber (16) near the piezoelectric crystal or equivalent (42), into desolvation chamber (46) in which the temperature is caused to exceed the boiling point of the solvent present, by heater means (46H). Application of said temperature produces a mixture of solvent vapor and nebulized sample particles (4SP). Said nebulized sample particles are typically passed through a solvent removal system (48) to form sample flow "S" and then introduced to the Afterglow portion (3B) of the electric discharge chamber of the present invention, as shown in FIG. 1, where ionized sample molecules and ionized sample fragments etc. (4SE) are produced as described above. The solvent removal system (48) can be a low temperature condenser or an enclosed filter solvent removal system. In the case of a low temperature condenser system the mixture of solvent vapor and nebulized sample particles is simply passed through a low temperature system in which the solvent vapor is condensed. In the case of an enclosed filter solvent removal system the mixture of solvent vapor and nebulized sample particles are passed through an enclosed filter which is permeable to solvent vapor, but not to nebulized sample particles. Solvent vapor which diffuses through the enclosed filter is removed by a sweep gas which is passed over the outside of the enclosed filter, or by the presence of low a temperature outside the enclosed filter which condenses the solvent vapor. In FIG. 2 element (47) diagramatically represents the sample flow path through a low temperature condenser, or the inner volume of an enclosed filter. The volume inside solvent removal system (48) but outside element (47) represents space through which a sweep gas can flow, or in the alternative, simply a low temperature environment.

It should be appreciated that the present invention is found in the system and method of use of the atmospheric pressure afterglow sample ionization system described, particularly as regards the electric discharge chamber system, and in the combination of the electric discharge chamber system with the other components of the overall MS sample analysis system (10). It should also be appreciated the the means for connecting to a mass spectrometer on the electric discharge chamber can comprise simply the open end of the electric discharge chamber (3) at the end of portion (3B) thereof, or said open end of the electric discharge chamber portion (3B) in combination with the CAJON connector or equivalent (5), momentum separator (6), skimmers (7) and (9) and associated vacuum pumps (8*b*) and (8*a*), or any portion of said elements, or functional equivalents, with or without other elements.

Having hereby disclosed the subject matter of the present invention, it should be obvious that many modifications, substitutions, and variations of the present invention are possible in light of the teachings. It is therefore to be understood that the invention may be practiced other than as specifically described, and should be limited in breadth and scope only by the claims.

I claim:

1. An electric discharge chamber system for use in mass spectrometer sample analysis systems using metastable species at atmospheric pressure to controllably fragment and ionize sample comprising:

an electric discharge chamber, which electric discharge chamber is elongated and essentially tubular in shape, and which electric discharge chamber is encompassed by an outer electric coil at an extent thereof at which means for accessing a source of matrix carrier gas is present; which electric discharge chamber, at an extent thereof distal to that at which the outer electric coil and means for accessing the source of matrix carrier gas are present, termed the "afterflow" portion of the electric discharge chamber, provides means for accepting sample and means for connecting to a mass spectrometer; such that during use electrical energy is provided to the outer electric coil and matrix carrier gas is entered into the electric discharge chamber through the means for accessing a source of matrix carrier gas, such that interaction between electric energy and matrix carrier gas during electric discharge causes formation of metastable species, which metastable species are caused to be transported to the afterglow portion of the electric discharge chamber whereat the energy therein interacts with sample introduced thereto at the means for accepting sample, which introduced sample does not pass through the extent of the electric discharge chamber in which electric discharge occurs and, hence, is not directly affected by energy other than that released from said metastable species, to produce ionized sample molecules and/or ionized sample fragments; which ionized sample molecules and/or ionized sample fragments are, during use, transported into a mass spectrometer which is connected to the means for connection thereto present on the electric discharge chamber, for detection by an ion detector element therein.

2. An electric discharge chamber system as in claim 1, in which the means for accepting sample includes a solvent removal system.

3. An electric discharge chamber system as in claim 1, in which the means for connecting to a mass spectrometer comprises a CAJON connector or equivalent, a momentum separator, and one or more skimmers.

4. An electric discharge chamber system for use in mass spectrometer sample analysis systems using metastable species at atmospheric pressure to controllably fragment and ionize sample comprising:

an electric discharge chamber, which electric discharge chamber is elongated and essentially tubular in shape and which electric discharge chamber is encompassed by an outer electrode at an extent thereof at which means for accessing a source of matrix carrier gas and an inner electrode present inside the electric discharge chamber are present; which electric discharge chamber, at an extent thereof distal to that at which the outer and inner electrodes and means for accessing the source of matrix carrier gas are present, termed the "afterglow" portion of the electric discharge chamber, provides means for accepting sample and means for connecting to a mass spectrometer; such that during use electrical energy is provided between the outer and inner electrodes and matrix carrier gas is entered to the electric discharge chamber through the means for accessing a source of matrix carrier gas, such that interaction between electric energy and matrix carrier gas during electric discharge causes formation of metastable species, which metastable species are caused to be transported to the afterglow portion of the electric discharge chamber whereat the energy therein interacts with sample introduced thereto at the means for accepting sample, which introduced sample does not pass through the extent of the electric discharge chamber in which electric discharge occurs and, hence, is not directly affected by energy other than that released from said metastable species, to produce ionized sample molecules and/or ionized sample fragments; which ionized sample molecules and/or ionized sample fragments are, during use, transported into a mass spectrometer which is connected to the means for connection thereto present on the electric discharge chamber, for detection by an ion detector element therein.

5. An electric discharge chamber system as in claim 4, in which the means for accepting sample includes a solvent removal system.

6. An electric discharge chamber system as in claim 4, in which the inner electrode is enclosed within a closed tubular or equivalent structure.

7. An electric discharge chamber system as in claim 2, in which the means for connecting to a mass spectrometer comprises a CAJON connector or equivalent, a momentum separator, and one or more skimmers.

8. An afterglow ionization system for use in mass spectrometer sample analysis systems using metastable species at atmospheric pressure to controllably fragment and ionize sample comprising:

a. an source of electrical energy;
b. an electric discharge chamber;
c. a source of matrix carrier gas;
d. a source of sample;

which source of electrical energy is adjustable as regards the power intensity delivered and/or frequency of operation thereof and which source of electrical energy feeds to an outer electric coil and/or feeds between an inner electrode inside the electric discharge chamber and the outer electric coil or electrode, which outer electric coil or electrode encompasses the electric discharge chamber at an extent thereof at which means for accessing the source of matrix carrier gas and said inner electrode when used, are present; which electric discharge chamber, at an extent thereof distal to that at which the outer electric coil or electrode, inner electrode when used and means for accessing the source of matrix carrier gas are present, termed the "afterglow" portion of the electric discharge chamber, provides means for accepting sample from the source of sample and means for connecting to a mass spectrometer; such that during use electrical energy is provided to the outer electric coil and/or between the outer electric coil or electrode and inner electrode and matrix carrier gas is entered to the electric discharge chamber through the means for accessing the source of matrix carrier gas, such that interaction during electric discharge causes formation of metastable species, which metastable species are caused to be transported to the afterglow portion of the electric discharge chamber whereat the energy therein interacts with sample introduced thereto, at the means for accepting sample, which introduced sample does not pass through the extent of the electric discharge chamber in which the electric discharge occurs and, hence, is not directly affected by energy other than that released from said metastable species, to produce ionized sample molecules and/or ionized sample fragments; which ionized sample molecules and/or ionized sample fragments are, during use, transported into a mass spectrometer which is connected to the means for connection thereto present on the electric discharge chamber, for detection by an ion detector element therein.

9. An afterglow ionization system as in claim 8, in which the source of sample is a system for introducing samples into sample analysis systems which comprises:

a. an aerosol chamber;
b. a piezoelectric crystal or equivalent;
c. a KAPTON film or equivalent;
d. a structural heat sink;
e. a sample outlet means;

which aerosol chamber comprises a means for allowing entry of a sample solution flow; means for connecting to the structural heat sink at one extent thereof and means for connecting to the sample outlet means at another extent thereof; which means for connecting to the structural heat sink is essentially tubular in shape with a constriction therein at some distance therealong; which KAPTON film or equivalent serves as an interface between the structural heat sink and the piezoelectric crystal or equivalent; which structural heat sink with KAPTON film or equivalent and piezoelectric crystal or equivalent on one extent thereof is connected to the aerosol chamber at the means for connection to said structural heat sink therein so that the piezoelectric crystal or equivalent is sandwiched between the structural heat sink, KAPTON film or equivalent and the constriction in the aerosol chamber means for connecting to the structural heat sink so that no sample retaining crevasses are present at the point of connection; which piezoelectric crystal or equivalent is, during use, caused to vibrate by application of electrical energy through an oscillator circuit of which it is an element; which piezoelectric crystal or equivalent is buffered in its contact with the structural heat sink as it vibrates, by the KAPTON film or equivalent and which KAPTON film or equivalent also serves to reflect and focus vibrational energy produced to a position at which it can be better utilized in nebulizing sample solution; which structural heat sink, at an extent thereof distal to that at which the KAPTON film or equivalent and piezoelectric crystal or equivalent are present, has present fins, which fins are subjected to a flow of cooling air during use, which cooling air serves to maintain the piezoelectric crystal or equivalent at a desired temperature by way of heat conduction along the structural heat sink; through which means for allowing entry of a sample solution flow in the aerosol chamber a sample solution flow is entered during use; such that during use the entering sample solution flow is impinged upon or in close proximity to the vibrating piezoelectric crystal or equivalent whereat said sample solution is nebulized to form sample solution droplets by interaction with the vibrational energy produced by the vibrating piezoelectric crystal or equivalent; which nebulized sample solution droplets can be transported into the sample outlet means to which the aerosol chamber is connected at the means for connection to the sample outlet means.

10. An afterglow ionization as in claim 9, in which the piezoelectric crystal or equivalent vibrates at one-and-three-tenths (1.3) megahertz.

11. An afterglow ionization system as in claim 9, which further comprises a nebulized sample solution droplet desolvation system connected to the sample outlet means at one extent of said sample solution droplet desolvation system, and an enclosed filter solvent removal system connected to the nebulized sample solution droplet desolvation system at an opposite extent thereof; to which nebulized sample solution droplet desolvation system and enclosed filter solvent removal system nebulized sample solution droplets can be entered during use; which nebulized sample solution droplet desolvation system serves to vaporize solvent and which enclosed filter solvent removal system serves to remove said vaporized solvent which diffuses through the enclosed filter, to provide nebulized sample particles inside the enclosed filter which can be transported into a sample analysis system for analysis by a detector therein.

12. An afterglow ionization system as in claim 11, in which the solvent removal system utilizes a flow of gas outside the enclosed filter to remove solvent vapor which diffuses through the enclosed filter.

13. An afterglow ionization system as in claim 11, in which the solvent removal system utilizes a low temperature condenser to condense and remove solvent vapor which diffuses through the enclosed filter.

14. A method of controllably fragmenting and ionizing sample comprising the steps of:

A. Obtaining an afterglow ionization system for use in mass spectrometer sample analysis systems using metastable species at atmospheric pressure to controllably fragment and ionize sample comprising:

a. an source of electrical energy;

b. an electric discharge chamber;

c. a source of matrix carrier gas;

d. a source of sample;

which source of electrical energy is adjustable as regards the power intensity delivered and/or frequency of operation thereof and which source of electrical energy feeds to an outer electric coil and/or feeds between an inner electrode inside the electric discharge chamber and the outer electric coil or electrode, which outer electric coil or electrode encompasses the electric discharge chamber at an extent thereof at which means for accessing the source of matrix carrier gas and said inner electrode when used, are present; which electric discharge chamber, at an extent thereof distal to that at which the outer electric coil or electrode, inner electrode when used and means for accessing the source of matrix carrier gas are present, termed the "afterglow" portion of the electric discharge chamber, provides means for accepting sample from the source of sample and means for connecting to a mass spectrometer; such that during use electrical energy is provided to the outer electric coil and/or between the outer electric coil or electrode and inner electrode and matrix carrier gas is entered to the electric discharge chamber through the means for accessing the source of matrix carrier gas, such that during electric discharge formation of metastable species occurs, which metastable species are caused to be transported to the afterglow portion of the electric discharge chamber whereat the energy therein interacts with sample introduced thereto at the means for accepting sample, which introduced sample does not pass through the extent of the electric discharge chamber in which electric discharge occurs and, hence, is not directly affected by energy other than that released from said metastable species, to produce ionized sample molecules and/or ionized sample fragments; which ionized sample molecules and/or ionized sample fragments are, during use, transported into a mass spectrometer which is attached to the electric discharged chamber at the means for connecting thereto on the electric discharge chamber, for detection by an ion detector element therein;

B. providing electrical energy to the outer electric coil and/or between the outer electric coil or electrode and the inner electrode to cause an electric discharge to occur inside the electric discharge chamber;

C. entering a flow of matrix carrier gas to the electric discharge chamber such that interaction between the matrix carrier gas and the electrical discharge energy produces metastable speciess;

D. causing the metastable species to be transported to the afterglow portion of the electric discharge chamber;

E. entering sample to the afterglow portion of the electric discharge chamber by a pathway not requiring said sample to pass through the extent of the electric discharge chamber in which electric discharge occurs during use, such that interaction between the energy released from metastable species and the entered sample produces a desired relative proportion of ionized sample molecules and/or ionized sample fragments.

15. A mass spectrometer sample analysis system which uses afterglow metastable species at atmospheric pressure to controllably fragment and ionize sample comprising:

a. an source of electrical energy;

b. an electric discharge chamber;

c. a source of matrix carrier gas;

d. a source of sample;

e. a momentum separator;

f. one or more skimmers; and g. a mass spectrometer ion detector element;

which source of electrical energy is adjustable as regards the power intensity delivered and/or frequency of operation thereof and which source of electrical energy feeds to an outer electric coil, and/or feeds between an inner electrode present inside the electric discharge chamber, and the outer electric coil or electrode, which outer electric coil or electrode encompasses the electric discharge chamber at an extent thereof at which means for accessing the source of matrix carrier gas and said inner electrode when used, are present; which electric discharge chamber, at an extent thereof distal to that at which the outer electric coil or electrode, inner electrode when used and means for accessing the source of matrix carrier gas are present, termed the "afterglow" portion of the electric discharge chamber, provides means for accepting sample from the source of sample and means for connecting to the momentum separator, at one extent thereof, which momentum separator, at a distally located extent thereof, connects to one extent of the one or more skimmers, at one extent thereof, and which one or more skimmers, at a distally located extent thereof, can connect to a mass spectrometer; such that during use electrical energy is provided to the outer electric coil and/or between the outer electric coil or electrode and inner electrode, and matrix carrier gas is entered to the electric discharge chamber through the means for accessing the source of matrix carrier gas, such that during electric discharge formation of metastable species occurs, which metastable species are caused to be transported to the afterglow portion of the electric discharge chamber whereat the energy therein interacts with sample introduced thereto at the means for accepting sample, which introduced sample does not pass through the extent of the electric discharge chamber in which electric discharge occurs and, hence, is not directly affected by energy other than that released from said metastable species, to produce ionized sample molecules and/or ionized sample fragments; which ionized sample molecules and/or ionized sample fragments are, during use, caused to be transported through the momentum separator and one or more skimmers into the mass spectrometer for detection by an ion detector element therein.

16. A mass spectrometer sample analysis system as in claim 15, in which the electric discharge chamber is connected to the momentum separator by means of the CAJON connector or equivalent, and which CAJON connector or equivalent is, during use, maintained at a temperature in excess of one-hundred (100) degrees centigrade.

17. A mass spectrometer sample analysis system as in claim 15, which further comprises a draw-out plate and a ion focusing lense system, which draw-out plate connects at one extent thereof to the one or more skimmers at the extent thereof not connected to the momentum separator, and at another extent thereof to the ion focusing lense system; which ion focusing lense system at an extent thereof not connected to the draw-out plate connects to the mass spectrometer such that ionized sample molecules and ionized sample fragments are caused to be transported through the momentum separator and one or more skimmers in the system for analyzing samples by an electric field created by application of a voltage to said draw-out plate, and which ionized sample molecules and ionized sample fragments which pass through a hole in said draw-out plate are guided by the ion focusing lense system into the mass spectrometer for detection by an ion detector element therein, and which further comprises one or more roughing vacuum pumps which operate to provide a pressure in the momentum separator, one or more skimmers, draw-out plate and ion focusing lense system which is less than the atmospheric pressure present in the electric discharge chamber.

18. A mass spectrometer sample analysis system as in claim 17 in which the ion detecting system is of the quadrapole type.

19. A mass spectrometer sample analysis system as in claim 17, in which sample transport through the electric discharge chamber of said system for analyzing samples is caused by the flow of matrix carrier gas and the presence of a lower pressure in the momentum separator, one or more skimmers, draw-out plate and ion focusing lense system than in the electric discharge chamber.

20. A mass spectrometer sample analysis system as in claim 15, in which the source of sample is a system for introducing samples into sample analysis systems which comprises:

a. an aerosol chamber;

b. a piezoelectric crystal or equivalent;

c. a KAPTON film or equivalent;

d. a structural heat sink;

e. a sample outlet means;

which aerosol chamber comprises a means for allowing entry of a sample solution flow; means for connecting to the structural heat sink at one extent thereof and means for connecting to the sample outlet means at another extent thereof; which means for connecting to the structural heat sink is essentially tubular in shape with a constriction therein at some distance therealong; which KAPTON film or equivalent serves as an interface between the structural heat sink and the piezoelectric crystal or equivalent; which structural heat sink with KAPTON film or equivalent and piezoelectric crystal or equivalent on one extent thereof is connected to the aerosol chamber at the means for connection to said structural heat sink therein so that the piezoelectric crystal or equivalent is sandwiched between the structural heat sink, KAPTON film or equivalent and the constriction in the aerosol chamber means for connecting to the structural heat sink so that no sample retaining crevasses are present at the point of connection; which piezoelectric crystal or equivalent is, during use, caused to vibrate by application of electrical energy through an oscillator circuit of which it is an element; which piezoelectric crystal or equivalent is buffered in its contact with the structural heat sink as it vibrates, by the KAPTON film or equivalent and which KAPTON film or equivalent also serves to reflect and focus vibrational energy produced to a position at which it can be better utilized in nebulizing sample solution; which structural heat sink, at an extent thereof distal to that at which the KAPTON film or equivalent and piezoelectric crystal or equivalent are present, has present fins, which fins are subjected to a flow of cooling air during use, which cooling air serves to maintain the piezoelectric crystal or equivalent at a desired temperature by way of heat conduction along the structural heat sink; through which means for allowing entry of a sample solution flow in the aerosol chamber a sample solution flow is entered during use; such that during use the entering sample solution flow is impinged upon or in close proximity to the vibrating piezoelectric crystal or equivalent whereat said sample solution is nebulized to form sample solution droplets by interaction with the vibrational energy produced by the vibrating piezoelectric crystal or equivalent; which nebulized sample solution droplets are transported into the sample outlet means to which the aerosol chamber is connected at the means for connection to the sample outlet means.

21. A mass spectrometer sample analysis system as in claim 20, in which the piezoelectric crystal or equivalent vibrates at one-and-three-tenths (1.3) megahertz.

22. A mass spectrometer sample analysis system as in claim 20, which further comprises a nebulized sample solution droplet desolvation system connected to the sample outlet means at one extent of said sample solution droplet desolvation system, and an enclosed filter solvent removal system connected to the nebulized sample solution droplet desolvation system at an opposite extent thereof; to which nebulized sample solution droplet desolvation system and enclosed filter solvent removal system nebulized sample solution droplets can be entered during use; which nebulized sample solution droplet desolvation system serves to vaporize solvent and which enclosed filter solvent removal system serves to remove said vaporized solvent which diffuses through the enclosed filter, to provide nebulized sample particles inside the enclosed filter which is transported into a sample analysis system for analysis by a detector therein.

23. A mass spectrometer sample analysis system as in claim 22, in which the solvent removal system utilizes a flow of gas outside the enclosed filter to remove solvent vapor which diffuses through the enclosed filter.

24. A mass spectrometer sample analysis as in claim 22, in which the solvent removal system utilizes a low temperature condenser to condense and remove solvent vapor which diffuses through the enclosed filter.

25. A method of producing ionized sample molecules and/or fragmented sample elements for analysis in mass spectrometer sample analysis systems which comprises the steps of:

A. Obtaining a mass spectrometer sample analysis system which uses afterglow metastable species at atmospheric pressure to controllably fragment and ionize sample comprising:
   a. an source of electrical energy;
   b. an electric discharge chamber;
   c. a source of matrix carrier gas;
   d. a source of sample;
   e. a momentum separator;
   f. one or more skimmers; and
   g. a mass spectrometer ion detector element;
   which source of electrical energy is adjustable as regards the power intensity delivered and/or frequency of operation thereof and which source of electrical energy feeds to an outer electric coil, and/or feeds between an inner electrode inside the electric discharge chamber and the outer electric coil or electrode, which outer electric coil or electrode encompasses the electric discharge chamber at an extent thereof at which means for accessing the source of matrix carrier gas and said inner electrode when used, are present; which electric discharge chamber, at an extent thereof distal to that at which the outer electric coil or electrode, inner electrode when used and means for accessing the source of matrix carrier gas are present, termed the "afterglow" portion of the electric discharge chamber, provides means for accepting sample from the source of sample and means for connecting to the momentum separator, at one extent thereof, which momentum separator, at a distally located extent thereof, connects to one extent of the one or more skimmers, at one extent thereof, and which one or more skimmers, at a distally located extent thereof, connects to a mass spectrometer; such that during use electrical energy is provided to the outer electric coil and/or between the outer electric coil or electrode and inner electrode, and matrix carrier gas is entered to the electric discharge chamber through the means for accessing the source of matrix carrier gas, such that during electric discharge formation of metastable species occurs, which metastable species are caused to be transported to the afterglow portion of the electric discharge chamber whereat the energy therein interacts with sample introduced thereto at the means for accepting sample, which introduced sample does not pass through the extent of the electric discharge chamber in which electric discharge occurs and, hence, is not directly affected by energy other than that released from said metastable species, to produce ionized sample molecules and/or ionized sample fragments; which ionized sample molecules and/or ionized sample fragments are, during use, caused to be transported through the momentum separator and one or more skimmers into the mass spectrometer for detection by an ion detector element therein;

B. providing electrical energy to the outer electric coil and/or between the outer electric coil or electrode which encompasses the electric discharge chamber, and the inner electrode, of a desired power intensity and operational frequency;

C. entering a flow of matrix carrier gas to the electric discharge chamber such that interaction between the matrix carrier gas and the discharge of electrical energy provided to the outer electric coil and/or between the outer electric coil or electrode which encompasses the electric discharge chamber, and the inner electrode, produces metastable species;

D. causing said metastable species to be transported to the afterglow portion of the electric discharge chamber;

E. entering sample to the afterglow portion of the electric discharge chamber by a pathway not requiring said sample to pass through the extent of the electric discharge chamber in which electric discharge occurs during use, such that interaction between the energy released from metastable species and the entered sample produces a desired relative proportion of ionized sample molecules and ionized sample fragments; and F. causing the ionized sample molecules and/or ionized sample fragments to be transported through the momentum separator, one or more skimmers and into the mass spectrometer ion detector element for detection.

26. An electric discharge chamber system for use in low internal pressure sample analysis systems using metastable species at atmospheric pressure to controllably fragment and ionize sample comprising:

an electric discharge chamber, which electric discharge chamber is elongated and essentially tubular in shape, and which electric discharge chamber is provided a means for entering electrical energy at an extent thereof at which means for accessing a source of matrix carrier gas is present; which electric discharge chamber, at an extent thereof distal to that at which the means for entering electrical energy and means for accessing the source of matrix carrier gas are present, termed the "afterglow" portion of the electric discharge chamber, provides means for accepting sample and means for connecting to a low internal pressure sample analysis system; such that during use electrical energy is provided to the means for entering electrical energy and matrix carrier gas is entered into the electric discharge chamber through the means for accessing a source of matrix carrier gas, such that interaction between the entered electrical energy and matrix carrier gas during the entering of electrical energy causes formation of metastable species, which metastable species are caused to be transported to the afterglow portion of the electric discharge chamber whereat the energy therein interacts with sample introduced thereto at the means for accepting sample, which introduced sample does not pass through the extent of the electric discharge chamber in which electrical energy is entered and, hence, is not directly affected by energy other than that, released from said metastable species, to produce ionized sample molecules and/or ionized sample fragments; which ionized sample molecules and/or ionized sample fragments, during use, transported into a low internal pressure sample analysis system which connected to the means for connection thereto present on the electric discharge chamber, for detection by an ion detector element therein.

* * * * *